United States Patent [19]

Dameron, Jr.

[11] Patent Number: 4,517,860

[45] Date of Patent: May 21, 1985

[54] PICTURE LOCATING TOOL

[76] Inventor: James L. Dameron, Jr., 3820 Delashmutt Dr., Haymarket, Va. 22069

[21] Appl. No.: 575,749

[22] Filed: Feb. 1, 1984

[51] Int. Cl.[3] ..... B25B 27/00

[52] U.S. Cl. ..... 81/487; 248/476

[58] Field of Search ..... 81/3 R, 3.49

[56] References Cited

U.S. PATENT DOCUMENTS 2,486,286 10/1949 Irving ..... 81/3.49

FOREIGN PATENT DOCUMENTS 395255 2/1909 France ..... 81/3.49

742331 12/1932 France ..... 81/3.49

*Primary Examiner*—Frederick R. Schmidt

*Assistant Examiner*—J. T. Zatarga

[57] ABSTRACT

A picture locating tool for determining the point of attachment for an object to be held in position against a mounting surface wherein the point of attachment is obscured. The tool by design locates the point so that a picture to be hung on a hanger or nail attached at the point will occupy the desired position on the mounting surface.

2 Claims, 1 Drawing Figure

PICTURE LOCATING TOOL

BACKGROUND OF THE INVENTION

This invention relates to the hanging of objects, such as pictures, plaques and other wall adornments wherein the placement of a hanging fixture to secure the object to a vertical surface is critical to the final location of the object when hung on a hanging fixture such as a nail or picture hook.

In mounting objects on a vertical surface, the point of attachment is obscured by the object when the object is held against the vertical surface and moved up, down, left and right to determine desired location.

Since the exact placement of picture, plaque or adornment on the wall is desired to obtain the best showing, a simple devise is needed to locate the point where the attachment fixture should be placed on the vertical surface.

OBJECTS OF THE INVENTIONS

Accordingly, it is an object of this invention to provide an accurate means of locating on a vertical surface, such as a wall, the point at which a mounting fixture is to be located for positioning a picture, plaque or adornment.

It is another object of the invention to eliminate guesswork, including trial and error in locating the vertical and horizontal position of a picture on a vertical surface and mounting same in selected position using the picture locating tool. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWING

The present invention will become more fully understood from the detailed description given hereinbelow and the accompanying drawing which is given by way of illustration only, and thus is not limitative of the present invention, and wherein.

DISCUSSION OF THE PREFERRED EMBODIMENT

Figure 1:
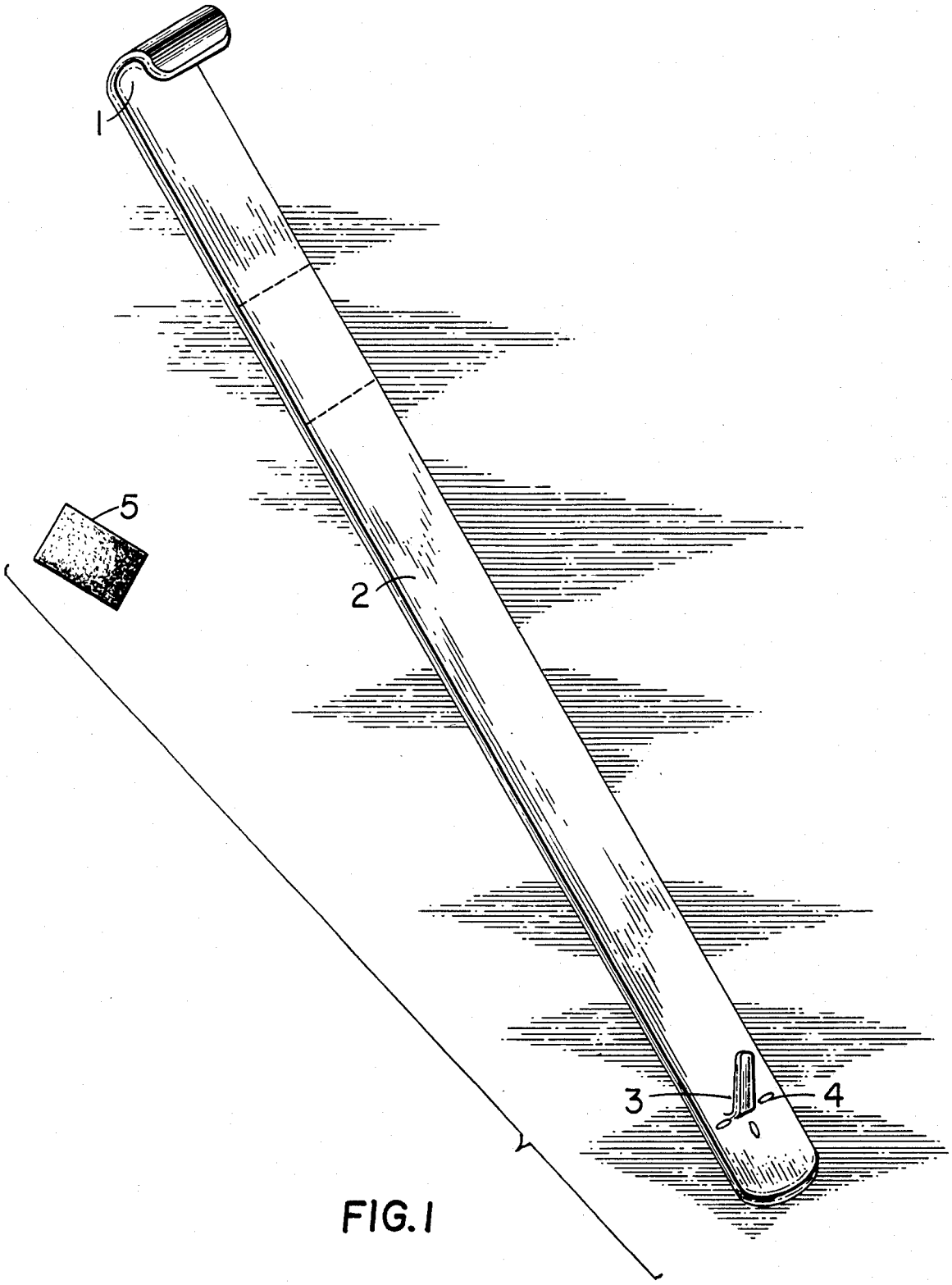
FIG. 1 is a perspective view of a picture locating tool according to the present invention.

FIG. 1 is a perspective view of a picture locating tool. The tool 2 may be fabricated from metal, plastic or a composition material having strength and rigidity. The length, width and thickness of material may vary depending on weight and size of an object being hung, and will also determine the length which is the distance from a holding flange 1 to point 3 where the picture is hung. The upper end or flange 1 of the tool is provided with a smooth bend of approximately 180° toward the protrusion on the lower end where the picture is hung.

An openings 4 are provided at the lower end of the tool below and to the left and right of point 3 where a picture is hung. The openings 4 are of a sufficient width to permit a pencil mark to be applied to the vertical surface behind the tool thereby defining the left and right limits of a point of attachment.

The protrusion at point 3 is positioned at an angle of approximately 30° from the surface of the tool 2 directing along the center line of tool 2.

The picture locating tool may be prefabricated by using a molding process or a stamp and bend procedure.

A thin rubberized backing 5 may be securely affixed to a back side of the picture locating tool to prohibit slipping or sliding from occurring when pressure is applied to the front side during a marking operation.

OPERATION

In operation, the flat back side of the picture locating tool is placed against a vertical surface with the thumb hooked under point 1. A picture is hung at point 3. The hand on which the thumb is hooked under the top of tool at point 1 can be moved along the vertical surface, either left or right or up or down, until the picture is in a desired position.

Pressure is then applied to the upper surface of the tool, pressing the tool against the vertical surface so as to keep the tool in place. The picture is then removed from point 3 and a mark is made on the vertical surface through the tool in the opening at point 4 or a nail may be positioned at point 4 and driven into the vertical surface. The opening in the tool is large enough so that the tool can be lifted off the vertical surface and clears the nail head.

Once a mark has been made on the vertical surface, a mounting device can be placed at that point and when the picture is hung, it will hang in the position as previously determined using the picture locating tool.

Having thus described my invention, what I claim as new, and desire to secure by Letters Patent is:

1. A picture locating tool comprising:

a substantially flat body member having a width and a selected length, said substantially flat body member having a first end and a second end with a flange member being provided at said first end and curved toward the second end and being parallel to the width dimension;

an elongated hole located adjacent to said second end of said body member at approximately the center of the width dimension;

a stud of selected length protruding from an upper end of said elongated hole which is furthest away from said second end at approximately the center of the width dimension and at an angle directed toward the first end;

said elongated hole being an open channel extending completely through said tool below said protruding stud and being of sufficient width to permit a pencil mark to be applied to the vertical surface behind said tool thereby defining a point of attachment.

2. A picture locating tool comprising:

a substantially flat body member having a width and a selected length, said substantially flat body member having a first end and a second end with a flange member being provided at said first end and curved toward the second end and being parallel to the width dimension;

an elongated hole located adjacent to said second end of said body member at approximately the center of the width dimension;

a stud of selected length protruding from an upper end of said elongated hole which is furthest away from said second end at approximately the center of the width dimension and at an angle directed toward the first end;

a thin rubberized backing securely affixed to a side of the picture locating tool opposite the side from which the flange and stud project for prohibiting slipping or sliding from occurring when pressure is applied to a front side during a marking operation;

an open channel extending completely through said tool on each side of said protruding stud of sufficient width to permit a pencil mark to be applied to the vertical surface behind said tool thereby defining the left and right limits of a point of attachment.

* * * * *